US009103139B2

(12) United States Patent
Clifford

(10) Patent No.: US 9,103,139 B2
(45) Date of Patent: Aug. 11, 2015

(54) KEY HAVING MOVABLE MEMBERS AND LOCKING SYSTEM

(71) Applicant: Schlage Lock Company LLC, Indianapolis, IN (US)

(72) Inventor: Jason C. Clifford, Colorado Springs, CO (US)

(73) Assignee: Schlage Lock Company LLC, Indianapolis, IN (US)

( * ) Notice: Subject to any disclaimer, the term of this patent is extended or adjusted under 35 U.S.C. 154(b) by 0 days.

(21) Appl. No.: 13/890,015

(22) Filed: May 8, 2013

(65) Prior Publication Data

US 2013/0298621 A1 Nov. 14, 2013

Related U.S. Application Data

(60) Provisional application No. 61/644,383, filed on May 8, 2012.

(51) Int. Cl.

| | |
|---|---|
| ***E05B 19/12*** | (2006.01) |
| ***E05B 27/06*** | (2006.01) |
| ***E05B 19/00*** | (2006.01) |
| ***E05B 27/08*** | (2006.01) |
| ***E05B 27/00*** | (2006.01) |
| ***E05B 35/00*** | (2006.01) |

(52) U.S. Cl.

CPC ..... *E05B 19/0052* (2013.01); *E05B 19/0017* (2013.01); *E05B 27/00* (2013.01); *E05B 27/08* (2013.01); *E05B 35/003* (2013.01)

(58) Field of Classification Search

CPC ..... E05B 19/0017; E05B 19/0023; E05B 19/0029; E05B 19/0035; E05B 19/0041; E05B 19/0052; E05B 19/0058; E05B 19/007; E05B 19/0094; E05B 19/14; E05B 27/0035; E05B 27/00; E05B 35/003

USPC ..... 70/358, 395, 398, 399, 409, 453, 493, 70/394, 337–339, 397, 401, 402, 405–407, 70/410–412, 494, 495, 419, 421, 359

See application file for complete search history.

(56) References Cited

U.S. PATENT DOCUMENTS

| | | | | | |
|---|---|---|---|---|---|
| 570,032 | A | * | 10/1896 | Luebbers | 70/493 |
| 742,815 | A | | 10/1903 | Valerius | |
| 1,382,826 | A | * | 6/1921 | Dove | 70/358 |
| 1,438,336 | A | | 12/1922 | Schroeder | |

(Continued)

FOREIGN PATENT DOCUMENTS

| | | | |
|---|---|---|---|
| EP | 0359885 | * | 3/1990 |
| WO | WO2009/012541 | * | 1/2009 |

OTHER PUBLICATIONS

International Search Report for PCT/US13/40218; Apr. 25, 2014; 2 pages.

(Continued)

*Primary Examiner* — Lloyd Gall

(74) *Attorney, Agent, or Firm* — Taft Stettinius & Hollister LLP

(57) ABSTRACT

An illustrative key includes first and second substantially vertical blades being connected by a substantially horizontal connecting member such that an axial channel is formed between the two blades. Members may be slidingly coupled to the connecting member such that the members are moveable into the channel.

20 Claims, 4 Drawing Sheets

(56) References Cited

U.S. PATENT DOCUMENTS

| | | | | | |
|---|---|---|---|---|---|
| 1,500,883 | A | * | 7/1924 | Muller | 70/358 |
| 1,735,868 | A | * | 11/1929 | Klingel | 70/421 |
| 3,877,267 | A | * | 4/1975 | Harris, Jr. | 70/358 |
| 3,902,342 | A | | 9/1975 | Zucker | |
| 4,126,025 | A | | 11/1978 | Miyamae | |
| 4,296,618 | A | | 10/1981 | Guiraud | |
| 4,377,082 | A | * | 3/1983 | Wolter | 70/493 |
| 4,440,010 | A | * | 4/1984 | Guiraud | 70/409 |
| 4,478,061 | A | * | 10/1984 | Preddey | 70/358 |
| 4,498,327 | A | | 2/1985 | Preddey | |
| 4,603,565 | A | * | 8/1986 | Strassmeir | 70/358 |
| 4,667,495 | A | * | 5/1987 | Girard et al. | 70/398 |
| 4,760,722 | A | | 8/1988 | Fann | |
| 4,787,225 | A | | 11/1988 | Hauser et al. | |
| 5,101,648 | A | * | 4/1992 | Kuster | 70/358 |
| 5,131,249 | A | * | 7/1992 | Baden et al. | 70/398 |
| 5,170,651 | A | * | 12/1992 | Errani | 70/493 |
| 5,222,383 | A | * | 6/1993 | Fann et al. | 70/358 |
| 5,349,830 | A | | 9/1994 | Keller | |
| 5,457,974 | A | * | 10/1995 | Keller | 70/358 |
| 5,493,884 | A | * | 2/1996 | Hinz et al. | 70/407 |
| 5,520,035 | A | | 5/1996 | Eizen et al. | |
| 5,533,369 | A | * | 7/1996 | Valdajos-Gallego | 70/493 |
| 5,775,144 | A | * | 7/1998 | Pagalday | 70/358 |
| 5,839,308 | A | * | 11/1998 | Eizen et al. | 70/358 |
| 5,894,750 | A | * | 4/1999 | Liaw | 70/359 |
| 6,481,255 | B2 | | 11/2002 | Theriault | |
| 6,508,091 | B1 | * | 1/2003 | Donatini | 70/359 |
| 6,584,819 | B1 | | 7/2003 | Hung | |
| 6,681,609 | B1 | | 1/2004 | Preddey | |
| 6,968,717 | B2 | | 11/2005 | Suzuki | |
| 7,370,503 | B2 | | 5/2008 | Keller | |
| 7,647,799 | B2 | * | 1/2010 | Markbreit et al. | 70/409 |
| 8,336,350 | B2 | * | 12/2012 | Nicoara | 70/395 |
| 8,387,425 | B2 | * | 3/2013 | Ben-Aharon et al. | 70/405 |
| 2004/0000178 | A1 | | 1/2004 | Tseng | |
| 2004/0148989 | A1 | | 8/2004 | Hsieh | |
| 2006/0272372 | A1 | * | 12/2006 | Talamonti et al. | 70/358 |
| 2007/0051146 | A1 | * | 3/2007 | Recondo Carayalde et al. | 70/409 |
| 2010/0212382 | A1 | | 8/2010 | Martikainen | |
| 2011/0302972 | A1 | | 12/2011 | Higuchi | |
| 2012/0055212 | A1 | | 3/2012 | Nicoara | |
| 2012/0073340 | A1 | | 3/2012 | Widen | |
| 2013/0340493 | A1 | * | 12/2013 | Mathachan et al. | 70/493 |

OTHER PUBLICATIONS

Written Opinion of the International Searching Authority for PCT/US13/40218; Apr. 25, 2014; 6 pages.

International Search Report and Written Opinion regarding counterpart PCT/US2013/040216 dated Sep. 9, 2013 (9 pages).

* cited by examiner

KEY HAVING MOVABLE MEMBERS AND LOCKING SYSTEM

CROSS REFERENCE TO RELATED APPLICATIONS

The present application claims the benefit of U.S. Provisional Patent Application No. 61/644,383 filed May 8, 2012, which is incorporated herein by reference.

BACKGROUND

The present invention relates to keys and locks operable by the same. Key-operable locks may face a number of challenges that can compromise the security of the lock such as unauthorized duplication of the keys. Many conventional keys are easily copied, for example by taking an impression of the key or tracing its profile. Accordingly, there remains a need for further contributions in this area of technology. The present application provides novel and non-obvious contributions to this area of technology.

SUMMARY

One embodiment of the present disclosure is a unique variable position key operable to be received in a keyway of a locking cylinder including a plurality of tumblers. Other embodiments include unique apparatuses, systems, devices, hardware, methods, and combinations for a multi-blade key and locking system. Further embodiments, forms, features, aspects, benefits, and advantages of the present application shall become apparent from the following description and drawings.

DETAILED DESCRIPTION OF ILLUSTRATIVE EMBODIMENTS

Figure 1A:
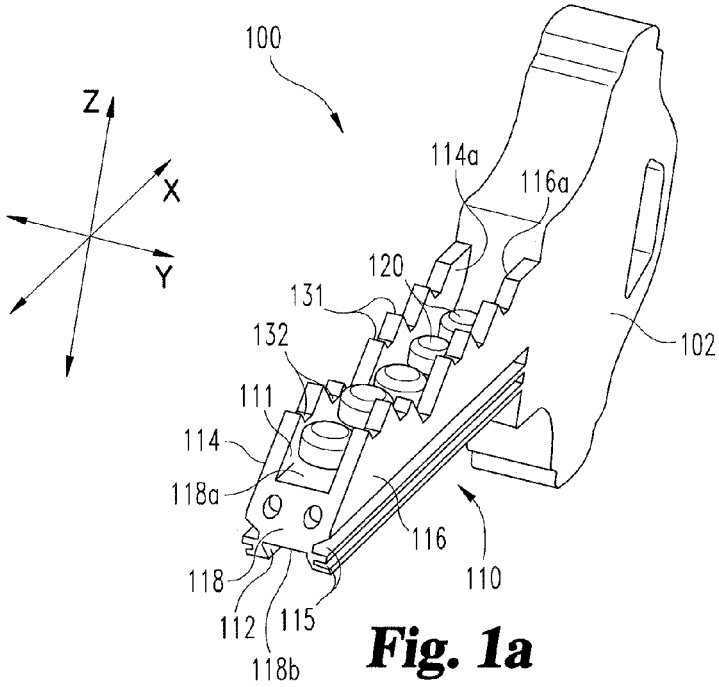
FIG. 1*a* is a perspective view of an example key.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

As used hereinafter, a reference to the length, height, or width of an element of a key is to be interpreted in light of the characterization of the dimensions and the following definitions unless specifically noted otherwise. The geometry of the key defines three mutually orthogonal axes, as illustrated in FIG. 1*a*; each dimension is measured along one of the axes. Width is measured along the first axis Y, defined as the direction in which the crossbar must extend to connect the blades. Width will be defined as the horizontal direction. Length is measured along a second axis X, defined as the axial direction of the shank. Height is measured along the third axis Z, the direction in which the bittings are formed (or in the case of a key blank, the direction in which bittings will be formed). The direction of the third axis Z will be considered a vertical direction. The present application contemplates that the dimensions and orientation may be substantially in the direction indicated or in the direction indicated.

Figure 1B:
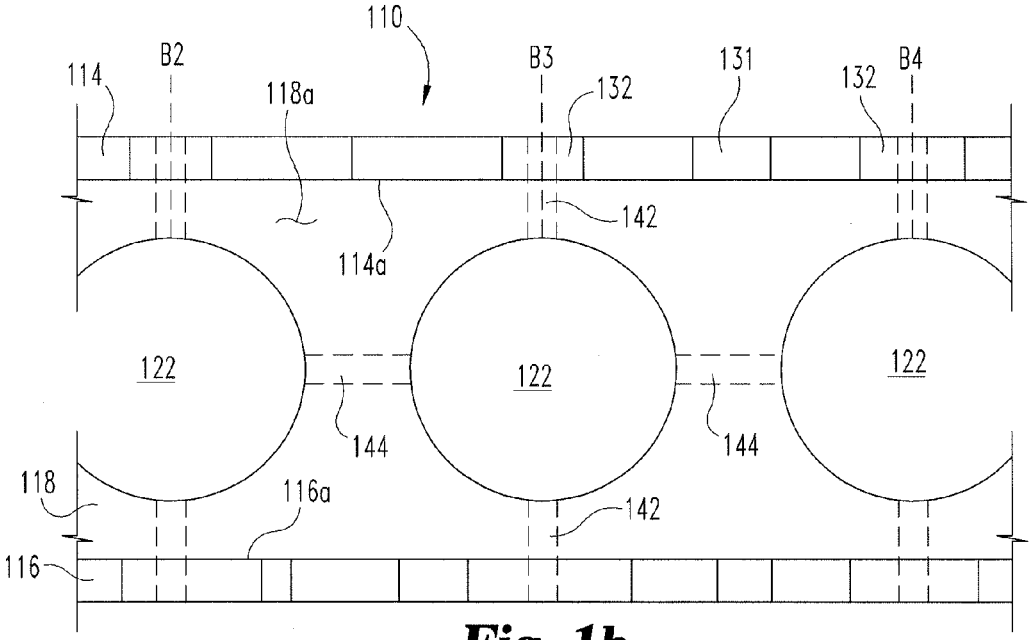
FIG. 1*b* is an elevational illustration of the key of FIG. 1*a*.

With reference to FIGS. 1*a* and 1*b*, there is illustrated an exemplary key 100 that includes a head portion 102 and a shank portion 110. Shank portion 110 includes vertical blades 114 and 116, and horizontal cross-bar 118. Crossbar 118 extends between blades 114, 116. The inner surfaces 114*a* and 116*a* respectively of blades 114, 116 cooperate with an upper surface 118*a* of crossbar 118 to define an upper channel or gap 111, and with a lower surface 118*b* of crossbar 118 to define a lower channel or gap 112. One or more of blades 114, 116 may include one or more grooves 115. One or more grooves 115 may be configured to receive a counter-shaped/correspondingly-shaped ward in a corresponding keyway, and may include side-bitting (not shown) to provide an additional layer of security. In the illustrated embodiment, blades 114, 116 each extend parallel to one another in the vertical direction, and crossbar 118 is perpendicular to blades 114, 116. The present application contemplates in other forms that the blades are not parallel to one another and that the crossbar may or may not be disposed perpendicular to one or both of the blades.

Crossbar 118 includes a plurality of through-bores 122 extending through and orthogonal to crossbar 118. Disposed within each through-bore 122 is a floating pin 120. Through-bores 122 are substantially aligned with bitting positions (a subset of which is illustrated in FIG. 1*b* as bitting positions B2-B4) such that, when shank portion 110 is inserted into a corresponding keyway, each floating pin 120 is aligned with a tumbling system. In the illustrated embodiment, blades 114, 116 include bittings 132 which are aligned with the same set of bitting positions as floating pins 120. In certain embodiments, the height of a blade 114, 116 at each bitting position (sometimes referred to as the root depth) may be selected from a finite set of root depths. For example, bittings 132 may be formed such that the root depth of each bitting position is provided by the formula RD=0.2+0.015*n±TF, where RD is the root depth in inches, n is an integer between zero and nine, inclusive, and TF is a tolerance factor having a value of 0.002. In other embodiments, the root depth at each bitting position may be selected according to different increments, or may be selected from a continuum of root depths. In other embodiments, one or more of blades 114, 116 may be bitted according to different bitting positions, or may not be bitted at all.

Cross-bar 118 further includes a plurality of radial bores 142 and/or a plurality of axial bores 144, each being connected to a through-bore 122. A rod/pin may be inserted through a bore 142, 144, and into a slot formed in a floating pin 120, such that floating pin 120 is slidingly coupled to crossbar 118. Further details of the sliding pins will be provided with respect to FIG. 2.

Figure 2:
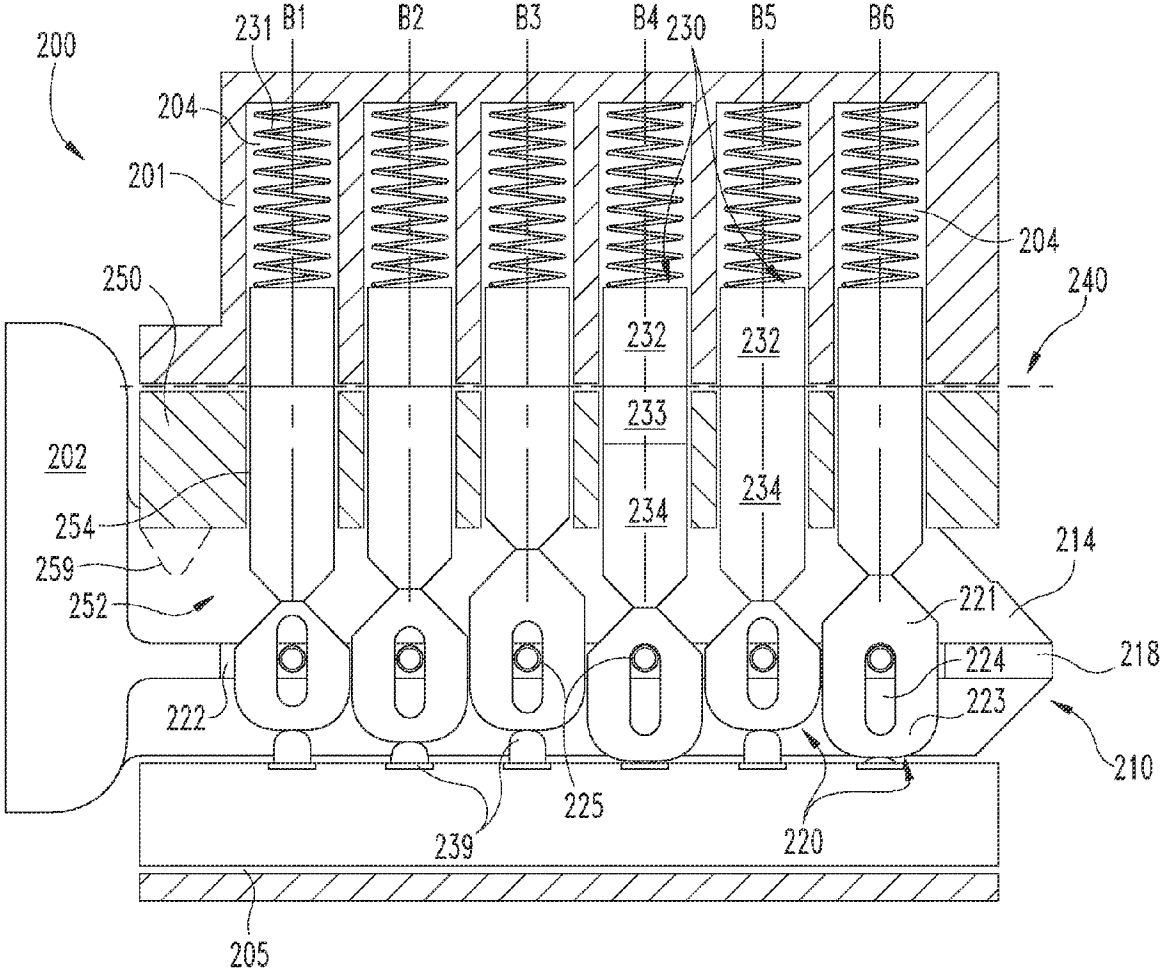
FIG. 2 is a cutaway view of an illustrative key-plug interaction.

FIG. 2 is an illustrative view of an example shank portion 210 which has been inserted into a corresponding locking mechanism 200. While floating pins 120 (as illustrated in FIG. 1) are of a uniform height, floating pins 220 are of varying heights. Further, while floating pins 120 are each disposed in a separate through-bore 122, floating pins 220 are disposed in a single through-hole 222 extending in the axial direction of shank portion 210.

Floating pins 220 include a tip portion 221 and a base portion 222, and have formed therein a cavity 224. Cavity 224 extends horizontally through floating pin 220, and extends vertically from a location proximate tip portion 221 to a location proximate base portion 223. Each cavity 224 is configured to receive a guide member 225. In the illustrated embodiment, guide members 225 are positioned in radial bores similar to radial bores 142, such that floating pins 220 are slidingly coupled to shank portion 210. That is to say, floating pins 220 are free to travel a distance corresponding to the vertical dimension of cavity 224. A floating pin 220 may include a biasing member (not shown) configured to urge the floating pin into a predetermined position. Floating pins 220 may be mounted such that they are restrained from angular displacement. For example, while guide members 225 are illustrated as having a circular cross-section, a cross-section of an alternate embodiment guide member 225 may instead include straight portions configured to engage the inner walls of cavities 224, thus hindering rotation. Additionally or alternatively, portions of the outer side of each floating pin 220 may contact another floating pin 220 or a wall defining the axial through-hole.

In the illustrated embodiment, cavity 224 is a through-hole which extends the entire width of floating pin 220, and guide member 225 extends through cavity 224. In other embodiments, the cavity may be a channel formed in the side of floating pin 220 such that the channel does not extend through floating pin 220. An example of such an embodiment is described below with respect to FIGS. 4*a* and 4*b*.

In FIG. 2, lock assembly 200 includes a shell 201, a plug 250, and a plurality of tumbling systems, here illustrated as pin tumbler sets 230. Shell 201 includes a plug cavity 205 in which plug 250 is positioned. Plug cavity 205 is generally cylindrical, but may include one or more grooves (not shown), for example if plug 250 includes sidebar locking features. Plug 250 includes a passage or keyway 252 configured to receive shank portion 210, and may include a ward (not illustrated) configured to prevent insertion of a key which does not have a counter-shaped/correspondingly-shaped groove. Keyway 252 is defined in part by a radial slot configured to receive crossbar 218. The plug 250 may include a protrusion 259 configured to urge floating pins 220 downward, such that a shank having a fixed inner blade cannot enter keyway 252. Plug 250 further includes a plurality of plug tumbler cavities 254 configured to align with corresponding shell tumbler cavities 204 formed in shell 210, thereby creating a tumbler chamber.

Disposed within each tumbler chamber is a spring 231 and a tumbler set 230. Each tumbler set 230 includes a driving pin 232 and a driven pin 234. Driven pins 234 are configured to travel along the surfaces of floating pin tip portions 221. One or more of the driven pin 234 and the floating member tip portion 221 may be rounded or tapered to facilitate such travel. One or more tumbler set 230 may further include one or more master key pin 233 between driving pin 232 and driven pin 234, such that lock assembly 200 can be master-keyed.

Located within keyway 252 are a plurality of positioning members 239. Positioning members 239 are configured to interact with floating pins 220 such that, upon insertion of shank portion 210 into keyway 252, floating pins 220 are urged in the vertical direction, which in turn urges tumbler sets 230 in the vertical direction. One or more of the positioning member 239 and the floating pin base portion 223 may be rounded or tapered to facilitate travel of floating pin 220. In the illustrated embodiment, each positioning member 239 is positioned on a first side of keyway 252, and each tumbler set 230 is positioned on a second side of keyway 252. It is also contemplated that a positioning member 239 may be positioned on the same side of keyway 252 as a tumbler set 230.

In tumbler sets 230, each pin contacts another pin at an interface; when a floating pin 220 is of the proper configuration, an interface of the corresponding tumbler set is substantially aligned with a shear line 240. When the proper shank portion 210 is inserted into keyway 252, an interface in each tumbling system is substantially aligned with shear line 240. This defines an unlocked state of locking system 200, in which plug 250 is free to rotate with respect to shell 201.

In the illustrated embodiment, the tumbling systems are sets of pin tumblers. In other embodiments, the tumbling systems may include other types of tumblers, such as wafer tumblers, disc tumblers, and lever tumblers, and may further include a sidebar locking feature. Furthermore, while locking assembly 200 is illustrated as a six-tumbler, key-in-knob/lever interchangeable core, other tumbler counts and other formats—such as full-size interchangeable core and small format interchangeable core—may be used.

In the illustrated embodiment, each positioning member 239 is releasably coupled to the plug, such that positioning members 239 are removable for rekeying operations, but do not move when shank portion 210 is inserted into keyway 252. In other embodiments, one or more positioning member 239 may be formed integrally with plug 250. In further embodiments, one or more positioning member 239 may be movable in the vertical direction upon insertion of shank portion 210.

Additionally, while in locking assembly 200 the tumbler sets 230 provide the interference which prevents plug 250 from rotating when in a locked state, the interference may additionally or alternatively be provided by other means. For example, plug 250 may include a sidebar locking mechanism (not shown) operable between a locked state in which a portion of the sidebar protrudes into a groove formed in shell 201 and an unlocked state in which the sidebar is at least partially retracted into plug 250.

Returning now to FIG. 1, blades 114, 116 include bittings 132 and teeth 131. In certain embodiments, one or more blade may not be bitted. For example, a corresponding locking system may be configured such that the tumbling systems are activated only by floating pins 120. As an additional example, key 100 may be manufactured as a blank key, to which bittings may be added later. In the illustrated embodiment, bittings 132 are formed on the upper surface of each blade. In other embodiments, bittings 132 may additionally or alternatively be formed on lower surface of one or more of the blades, as in key 400 (described below). In further embodiments, the vertical sides of the blades may be bitted, for example to engage additional tumbling systems.

Figure 3:
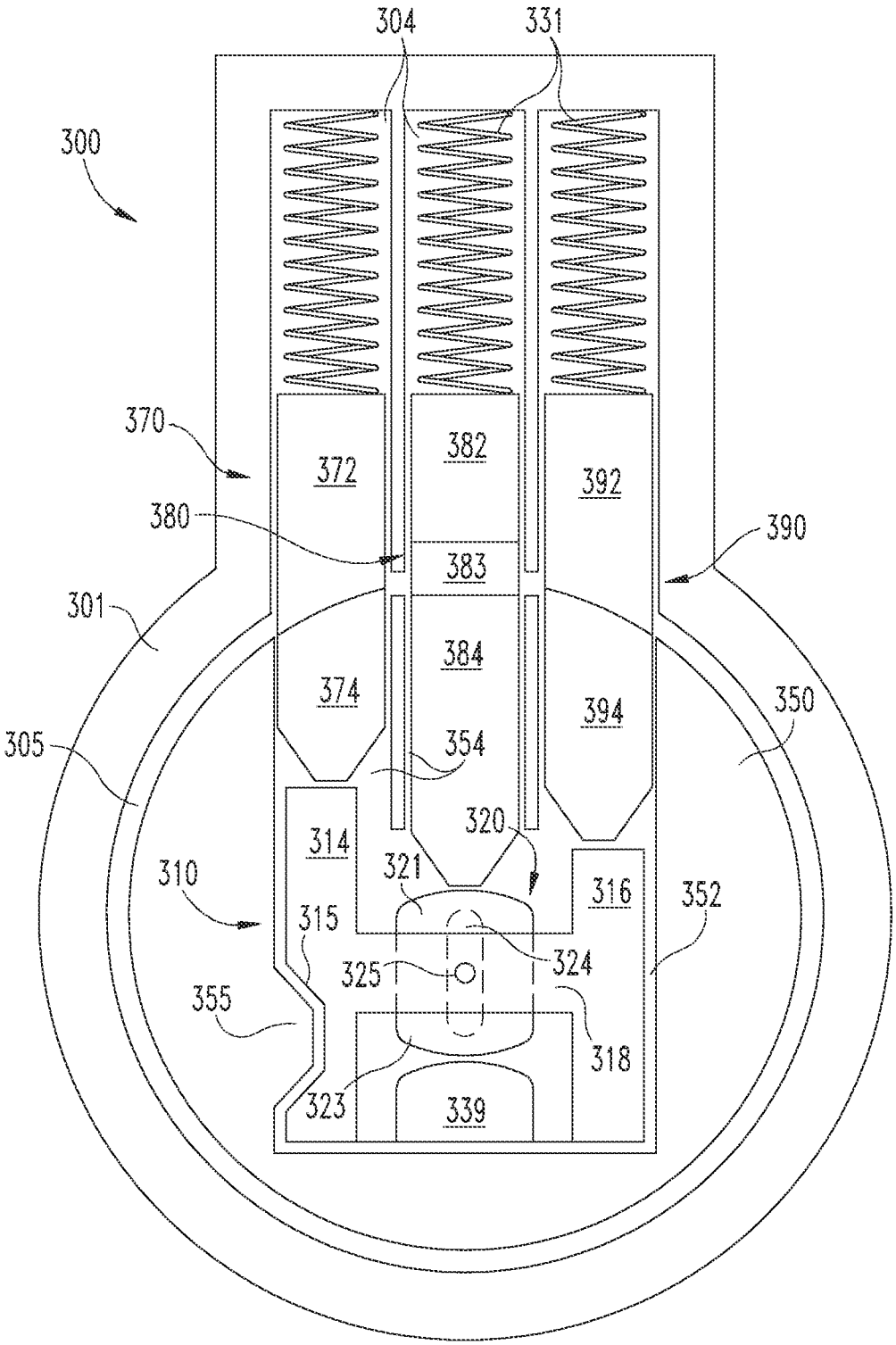
FIG. 3 is a cross-sectional view of an example locking system.

In embodiments which include bittings 132, blades 114, 116 may define an identical configuration of bittings 132, or may define different configurations. For example, with respect to FIG. 3, locking system 300 includes three tumbler sets 370, 380, 390 at each bitting position. Shank portion 310 includes blades 314, 316 and floating pin 320, the vertical position of which is adjusted by positioning member 339. In the illustrated embodiment, floating pin 320 is aligned with a central axial plane of plug 350, and blades 314, 316 are parallel to the central axial plane. Other embodiments are also contemplated. For example, one or more of blades 314, 316 may be substantially parallel to the central axial plane or may be offset at another angle. Each of blades 314, 316, and floating pin 320 is configured to adjust the position of a different tumbler set. Blade 314 adjusts the position of tumbler set 370, floating pin 320 adjusts the position of tumbler set 380, and blade 316 adjusts the position of tumbler set 390.

Although tumbler sets 370, 380, 390 are each parallel to blades 314, 316 in other embodiments, one or more tumbler set may be offset with respect to a blade.

In the illustrated embodiment, each tumbling system is a pin tumbler set. In other embodiments, the tumbling systems may include other types of tumblers, such as wafer tumblers, disc tumblers, and lever tumblers, and may further include a sidebar locking feature. While tumbler sets 370, 380, 390 are aligned to the same bitting positions, in other embodiments the tumbling systems may be aligned with different bitting positions.

Figure 4A:
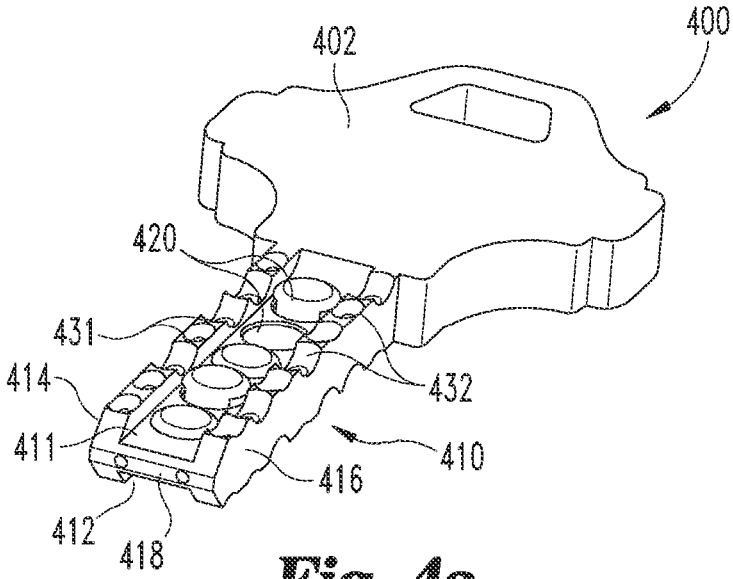
FIG. 4*a* is a perspective view of an example key.
Figure 4B:
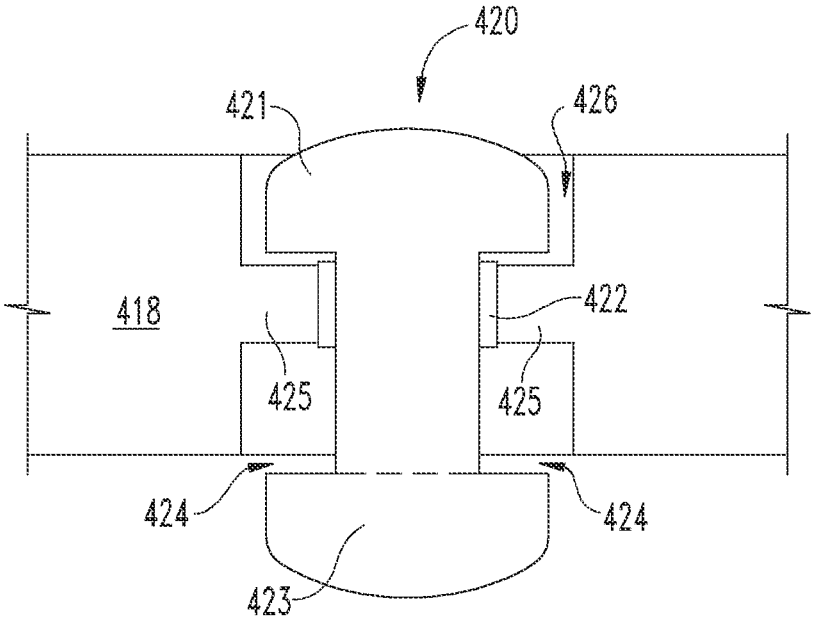
FIG. 4*b* is a cutaway view of the key of FIG. 4*a*.

While the embodiments described hereinabove illustrate vertical keys, in other embodiments the key may be a horizontal, Euro-style key. FIGS. 4*a* and 4*b* illustrate an example embodiment of a horizontal key 400, in which elements similar to those of the key 100 are labeled with similar reference characters. Key 400 includes a head portion 402 and a shank portion 410, which includes blades 414, 416, and crossbar 418. Blades 414, 416 include bittings 432 on both the top and the bottom surfaces, which may be configured such that key 400 is reversible. It is also contemplated that bittings 432 may be formed on only the top surface or only the bottom surface of one or more of blades 414, 416.

Floating pins 420 have channels 424, and are slidingly coupled to crossbar 418 such that floating pins 420 are movable in the vertical direction. Each floating pin 420 is partially positioned in a seating cavity 426, and extends vertically through a through-hole 422. Through-holes 422 are configured such that floating pins 420 are located at a plurality of bitting positions, at least some of which are different than the bitting positions at which bittings 432 are located. In other embodiments, each floating pin 420 may be aligned with the bitting positions of bittings 432.

Through-hole 422 is defined in part by protrusions 425, which are configured to be received in channels 424. The relative sizes of channels 424 and protrusions 425 are such that floating pins 420 are vertically movable between a lower terminal position in which base portion 423 is positioned in lower channel 412 and an upper terminal position in which tip portion 421 is positioned in upper channel 411. In the illustrated embodiment, a first section of floating pin 420 defines tip portion 421 and the vertical surface of channel 424, and a second section defines base portion 422. In other embodiments, the first and second sections may be identical, each defining a segment of the vertical surface of channel 424. In the manufacturing process, the first section may be inserted in through-hole 422 such that protrusion 425 is positioned within channel 424, and the second section is coupled to the first section. The first and second sections may be coupled by any method known in the art, such as an interference fit, epoxy or brazing.

In the embodiment of FIG. 4, channels 424 and protrusions 425 have substantially straight surfaces in the axial direction of shank portion 410, such that floating pins 420 can move vertically, but cannot rotate. In other embodiments, one or more floating pin 420 may be slidingly coupled to crossbar 418 such that the floating pin is both vertically movable and rotatable with respect to crossbar 418. For example, channel 424 may be formed on the entire circumference (or an arcuate segment thereof) of floating pin 420. Furthermore, while protrusion 425 is formed integrally with crossbar 418, it is also contemplated that protrusion 425 may be a rod having a first end positioned in a corresponding cavity in crossbar 418 and a second end protruding into channel 424.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A locking system comprising:

a key comprising:

a first vertical blade, a second vertical blade, and a horizontal connecting portion coupling the first and second blades in a spaced relationship defining a gap; and a plurality of rigid members slidingly coupled to the key and each of the plurality of rigid members is movable in a direction perpendicular to a plane defined by the connecting portion, and at least a portion of each of the plurality of rigid members is positioned in the gap; and a lock comprising:

a housing defining a substantially cylindrical cavity;

a plug positioned in the cavity, the plug including a passage configured to receive the key;

a plurality of tumblers, each tumbler being operable between a locked state in which the tumbler prevents rotation of the plug with respect to the housing and an unlocked state in which the tumbler does not prevent rotation of the plug with respect to the housing; and a plurality of protrusions in the passage, each of the plurality of protrusions configured to urge one of the rigid members into a position in which the rigid member urges one of the tumblers into the unlocked state; and wherein, when the key is inserted, a central axis of a first of the tumblers is aligned with the first blade, a central axis of a second of the tumblers is aligned with the second blade, and a central axis of a third of the tumblers is configured to engage one of the rigid members, and wherein the central axes of the first, second, and third tumblers are arranged substantially parallel to one another.

2. The system of claim 1, wherein the first blade is configured to urge at least some of the tumblers into the unlocked state.

3. A key, comprising:

a head portion;

a shank portion including:

a crossbar extending from the head portion along a horizontal plane including first and second perpendicular axes;

two vertically oriented blades positioned on opposing sides of the crossbar and extending in a direction of a third axis, wherein the third axis is perpendicular to the first and second axes; and a plurality of floating pins slidingly coupled to the crossbar, wherein each of the floating pins comprises a height in the direction of the third axis greater than a width in a direction of the first or second axis, is movable in the direction of the third axis, and is restrained from rotation about the first and second axes;

wherein the height of each of the floating pins is different from the height of another of the floating pins.

4. The key of claim 3, wherein each of the floating pins comprises a substantially cylindrical body comprising a longitudinal axis parallel to the third axis.

5. The key of claim 3, wherein at least one of the blades comprises bittings formed in the direction of the third axis.

6. The key of claim 3, each of the floating pins comprising a base portion, a tip portion offset from the base portion along the direction of the third axis, and a cavity;

wherein, in each of the floating pins, the cavity extends through the floating pin along a direction of the first axis, and extends along the direction of the third axis between a location proximate the base portion and a location proximate the tip portion; and wherein the shank portion further comprises at least one guide member extending along the direction of the first axis through the cavity of at least one of the floating pins, thereby slidingly coupling the at least one of the floating pins to the crossbar.

7. The key of claim 6, wherein the blades are offset from one another along the first axis, the at least one guide member comprises a plurality of guide members, and each of the guide members extends through the cavity of a corresponding one of the floating pins.

8. The key of claim 6, wherein the blades are offset from one another along the second axis, and the at least one guide member extends through the cavity of each of the floating pins.

9. A system, comprising:

a lock including:

a shell;

a plug rotatably mounted in the shell, the plug including a keyway extending along an axial plane of the plug;

a first tumbler set including a plurality of first tumblers positioned on a first side of the axial plane;

a second tumbler set including a plurality of second tumblers positioned on a second side of the axial plane;

a third tumbler set including a plurality of third tumblers aligned with the axial plane; and a plurality of positioning members seated in the keyway, wherein each of the positioning members extends toward one of the third tumblers;

wherein each of the tumblers has a locked state in which the tumbler prevents rotation of the plug with respect to the shell, and an unlocked state in which the tumbler does not prevent rotation of the plug with respect to the shell; and a key including:

a first blade, a second blade, and a crossbar connecting the first blade and the second blade; and a plurality of floating pins slidingly coupled to the crossbar at a plurality of floating pin bitting positions;

wherein the positioning members are configured to urge the floating pins along the axial plane and into contact with the third tumblers as the key is inserted into the keyway;

wherein, with the key inserted in the keyway:

the first blade is engaged with the first tumbler set, and each of the first tumblers is in the unlocked state;

the second blade is engaged with the second tumbler set, and each of the second tumblers is in the unlocked state;

the positioning members are engaged with the floating pins, the floating pins are engaged with the third tumbler set, and each of the third tumblers is in the unlocked state; and the first blade and the second blade are parallel with the axial plane.

10. The system of claim 9, wherein the crossbar is oriented perpendicular to the first blade and the second blade.

11. The system of claim 9, wherein each of the plurality of floating pins has a height dimension that is not equal to the height dimension of an adjacent floating pin.

12. The system of claim 9, wherein the first blade defines a first plurality of bittings at a first plurality of blade bitting positions.

13. The system of claim 12, wherein the plurality of floating pin bitting positions is aligned with the first plurality of blade bitting positions.

14. The system of claim 12, wherein a root depth of the first blade at each of the first plurality of blade bitting positions is selected from the group consisting of 0.2 inches, 0.215 inches, 0.23 inches, 0.245 inches, 0.26 inches, 0.275 inches, 0.29 inches, 0.305 inches, 0.32 inches, and 0.335 inches, each within a tolerance of 0.002 inches.

15. The system of claim 12, wherein the second blade defines a second plurality of bittings at a second plurality of blade bitting positions.

16. The system of claim 9, wherein the crossbar defines a through-hole;

wherein one of the floating pins comprises a lower portion, an upper portion, and a central portion extending between the lower portion and the upper portion, wherein a height of the central portion is greater than a height of the through-hole, and each of a width of the upper portion and a width of the lower portion is greater than each of a width of the central portion and a width of the through-hole;

wherein the central portion extends through the through-hole, such that the one of the floating pins is slidingly coupled to the crossbar.

17. The system of claim 9, wherein the axial plane is a central axial plane.

18. The system of claim 9, wherein each of the tumbler sets extends parallel to the axial plane.

19. The locking system of claim 9, wherein the positioning members are releasably coupled to the plug.

20. The locking system of claim 9, wherein each of the positioning members has a vertical dimension within the keyway, and the vertical dimension of each of the positioning members is different from the vertical dimension of another of the positioning members.

* * * * *